US007878705B2

(12) United States Patent
Schauerte

(10) Patent No.: US 7,878,705 B2
(45) Date of Patent: Feb. 1, 2011

(54) STATIC MIXING ELEMENT AND METHOD OF MIXING A DRILLING LIQUID

(75) Inventor: Manfred Schauerte, Schmallenberg (DE)

(73) Assignee: TT Schmidt GmbH, Lennestadt (DE)

( * ) Notice: Subject to any disclaimer, the term of this patent is extended or adjusted under 35 U.S.C. 154(b) by 0 days.

(21) Appl. No.: 11/748,313

(22) Filed: May 14, 2007

(65) Prior Publication Data

US 2007/0211570 A1 Sep. 13, 2007

(30) Foreign Application Priority Data

Apr. 20, 2000 (DE) ..... 100 19 759 U

(51) Int. Cl.
*B01F 5/06* (2006.01)

(52) U.S. Cl. ..... 366/337; 366/340

(58) Field of Classification Search ..... 366/181.5, 366/336–341; 138/40, 42
See application file for complete search history.

(56) References Cited

U.S. PATENT DOCUMENTS

| | | | | | |
|---|---|---|---|---|---|
| 1,977,300 | A | | 10/1934 | Blunt | |
| 2,561,457 | A | * | 7/1951 | Beales et al. | 366/268 |
| 3,045,984 | A | * | 7/1962 | Cochran | 366/340 |
| 3,417,967 | A | * | 12/1968 | Richens et al. | 366/144 |
| 3,473,787 | A | * | 10/1969 | Bartlett | 366/176.2 |
| 3,593,964 | A | * | 7/1971 | Morane | 366/340 |
| 3,693,457 | A | * | 9/1972 | Pilat | 73/865.5 |
| 3,744,762 | A | * | 7/1973 | Schlicht | 366/338 |
| 3,791,255 | A | | 2/1974 | Fox et al. | |
| 3,856,270 | A | * | 12/1974 | Hemker | 366/340 |
| 3,935,910 | A | | 2/1976 | Gaudy et al. | |
| 3,941,355 | A | * | 3/1976 | Simpson | 366/99 |
| 4,050,479 | A | * | 9/1977 | Baumann | 138/42 |
| 4,051,065 | A | | 9/1977 | Venema | |
| 4,087,862 | A | * | 5/1978 | Tsien | 366/165.1 |
| 4,124,309 | A | * | 11/1978 | Yao | 366/340 |
| 4,264,212 | A | * | 4/1981 | Tookey | 366/3 |
| 4,313,680 | A | * | 2/1982 | Honnen | 366/337 |
| 4,334,788 | A | | 6/1982 | Miner | |
| 4,340,311 | A | * | 7/1982 | Crandal | 366/336 |
| 4,344,752 | A | * | 8/1982 | Gallagher, Jr. | 431/354 |
| 4,361,407 | A | * | 11/1982 | Pellegrini | 366/340 |
| 4,370,062 | A | * | 1/1983 | Moody | 366/130 |
| 4,409,850 | A | | 10/1983 | Zeck | |
| 4,412,582 | A | | 11/1983 | Mecozzi et al. | |
| 4,415,275 | A | * | 11/1983 | Dietrich | 366/165.1 |
| 4,416,610 | A | * | 11/1983 | Gallagher, Jr. | 431/4 |
| 4,441,823 | A | * | 4/1984 | Power | 366/167.1 |

(Continued)

FOREIGN PATENT DOCUMENTS

| | | |
|---|---|---|
| CH | 182 064 | 1/1936 |

(Continued)

OTHER PUBLICATIONS

Schwald, G., et al., "Leistungsparameter bei Statikmischern," Wagen & Dosieren, Mar. 1997, S. 23-26.

*Primary Examiner*—Charles Cooley
(74) *Attorney, Agent, or Firm*—Cook Alex Ltd.

(57) ABSTRACT

Static mixer element for homogenizing media and methods of mixing a drilling liquid are disclosed. The static mixer includes a housing and a deflection surface arranged within the housing at a selected angle with respect to the flow direction.

9 Claims, 1 Drawing Sheet

U.S. PATENT DOCUMENTS

| | | | | | |
|---|---|---|---|---|---|
| 4,514,095 | A | * | 4/1985 | Ehrfeld et al. | 366/340 |
| 4,548,525 | A | * | 10/1985 | Priebe | 405/52 |
| 4,647,212 | A | * | 3/1987 | Hankison | 366/165.5 |
| 4,684,254 | A | * | 8/1987 | Goudy, Jr. | 366/340 |
| 4,729,665 | A | * | 3/1988 | Goudy, Jr. | 366/340 |
| 4,854,721 | A | * | 8/1989 | Hume | 366/340 |
| 4,869,849 | A | * | 9/1989 | Hirose et al. | 261/78.2 |
| 4,874,248 | A | * | 10/1989 | Luetzelschwab | 366/307 |
| 4,907,725 | A | * | 3/1990 | Durham | 222/129.1 |
| 4,981,368 | A | * | 1/1991 | Smith | 366/337 |
| 5,145,256 | A | * | 9/1992 | Wiemers et al. | 366/336 |
| 5,161,456 | A | * | 11/1992 | Ehrlinger et al. | 99/323.2 |
| 5,335,992 | A | * | 8/1994 | Holl | 366/348 |
| 5,404,913 | A | * | 4/1995 | Gilligan | 138/37 |
| 5,522,661 | A | | 6/1996 | Tsukada | |
| 5,547,281 | A | * | 8/1996 | Brooks | 366/340 |
| 5,549,222 | A | * | 8/1996 | Schroeder | 222/129.1 |
| 5,688,478 | A | * | 11/1997 | Pounds et al. | 423/228 |
| 5,690,820 | A | * | 11/1997 | Becnel et al. | 210/170.01 |
| 5,839,828 | A | * | 11/1998 | Glanville | 366/340 |
| 5,887,977 | A | * | 3/1999 | Morikawa | 366/340 |
| 5,967,658 | A | * | 10/1999 | Mohajer | 366/337 |
| 6,217,009 | B1 | * | 4/2001 | Rowe | 261/78.2 |
| 6,279,611 | B2 | * | 8/2001 | Uematsu et al. | 137/888 |
| 6,305,835 | B1 | * | 10/2001 | Farrar et al. | 366/162.4 |
| 6,337,308 | B1 | | 1/2002 | Adams et al. | |
| 6,447,158 | B1 | * | 9/2002 | Farkas | 366/316 |
| 6,530,684 | B1 | * | 3/2003 | Kolb et al. | 366/176.1 |
| 6,595,682 | B2 | * | 7/2003 | Mathys et al. | 366/337 |
| 7,575,071 | B2 | * | 8/2009 | Schauerte | 175/62 |
| 2002/0125046 | A1 | * | 9/2002 | Schauerte | 175/57 |
| 2004/0100864 | A1 | * | 5/2004 | Schauerte | 366/340 |
| 2007/0211570 | A1 | * | 9/2007 | Schauerte | 366/337 |
| 2008/0041449 | A1 | * | 2/2008 | Schauerte | 137/7 |

FOREIGN PATENT DOCUMENTS

| | | | | |
|---|---|---|---|---|
| DE | 687 926 | | | 2/1940 |
| DE | 77 33 456 | | | 11/1978 |
| DE | 36 18 062 | A1 | | 12/1987 |
| DE | 4217373 | A1 | | 12/1993 |
| DE | 199 18 775 | | | 10/1999 |
| DE | 10032302 | A1 | * | 10/2001 |
| EP | 0 191 453 | A2 | | 2/1986 |
| EP | 196280 | A2 | * | 10/1986 |
| EP | 0 994 235 | A2 | | 10/1999 |
| GB | 2063695 | A | * | 6/1981 |
| JP | 61242624 | A | | 10/1986 |
| SU | 725689 | | * | 4/1980 |
| SU | 1456205 | | * | 2/1989 |
| WO | WO 8803052 | A1 | * | 5/1988 |
| WO | WO/01/80985 | | | 11/2001 |

* cited by examiner

STATIC MIXING ELEMENT AND METHOD OF MIXING A DRILLING LIQUID

CROSS-REFERENCE TO RELATED APPLICATIONS

This application is a continuation of and claims priority to U.S. patent application Ser. No. 10/257,830, now abandoned, which is a U.S. national stage application of International Application No. PCT/EP01/04516, filed Apr. 20, 2001, which claims foreign priority to German Patent Application 100 19 759.0-23, filed Apr. 20, 2000, the contents of all of the above applications are hereby incorporated by reference.

BACKGROUND OF THE INVENTION

Increasingly high requirements are placed on homogenizing and dispersing media of the same or different aggregate states as a precondition of a large number of process steps in chemical or engineering technology, said requirements having to be met with the aid of generally complex static or dynamic mixing systems.

During horizontal drilling, too, there is the requirement to mix a liquid with a powdered substance or a liquid or a suspension if, in order to facilitate and improve the drilling operation, for example a bentonite-water suspension is to be used as a drilling or flushing liquid. Such a suspension keeps the drilling dust in suspension, lubricates the pipe string as it is pulled in and protects the latter against the surrounding earth after a certain hardening phase. In order to vary the characteristics of the suspension, additives, such as soda ash or polymers, can be added.

Drilling liquids are normally mixed in a separate storage tank by means of a stirrer operating in this tank, that is to say a dynamic mixer, or by means of a high-speed pump.

These mixing systems have an increased requirement for space and lead to time delays in the drilling operation if, after a batch of drilling liquid has been used, a new batch has to be prepared. They do not permit a compact design of the overall drilling system.

Static mixing systems are also known which, as opposed to dynamic systems, do not have any stirrer and require less space.

The use of static mixers in mixing systems for the production of drilling liquid for horizontal drilling methods is known from German Patent Application 199 18 775.4. In the method described therein for the production of a drilling liquid, the added medium, for example bentonite, is led to the water in powder form upstream or downstream of a hydraulic pump that transports the drilling liquid to the drilling system A static mixing section, which homogenizes the added substance and the water, can be arranged downstream of the pump.

A static mixer, as known for example from "wägen+dosieren" (weighing and metering) 3/1997, pages 23 to 26, generally comprises a plurality of different types of individual mixer elements which are connected one after another and can be inserted into a feed line or discharge line system with the aid of an adapter. Each of these mixer elements has one or more deflection surfaces which, if necessary, are penetrated by one or more passages. The deflection surfaces following one another either within a mixer element or in mixer elements connected downstream are in this case always inclined at small angles with respect to one another and likewise, coincident with the flow direction of the medium flowing in the line, have a small angle of inclination that differs from 90°.

The deflection surfaces, which are at a particular axial angle in relation to one another and to the flow direction, produce forcible guidance of the flow, so that its flow direction rotates repeatedly. The passages which may penetrate the deflection surfaces likewise run at angles to one another and to the deflection surfaces so that both the flow is divided up and a repeated change in the flow direction takes place. The individual streams are guided together again at other deflection surfaces.

This repeated division, deflection and guiding together of the media has the effect of its homogenization or dispersion.

The selection of different mixer geometries is made as a function of the Reynolds number which, as the quotient of the inertial forces and the frictional forces, depends, amongst other things, on the material characteristics of the media. At a critical flow velocity, the inertial forces exceed a characteristic value, as compared with the frictional forces, so that the flow becomes turbulent.

Furthermore, the selection of the mixer geometries and the size of the overall mixing system, that is to say the number of mixer elements connected one after another, is made as a function of the permissible pressure loss in the flow, which primarily has to be assessed in view of the critical velocity required for the turbulence and the requirements of the process steps which follow.

Furthermore, the geometry of the deflection surfaces and passage openings and their arrangement relative to one another and to the flow direction have to be arranged in such a way that, as far as possible, the absence of dead zones can be ensured, since these prevent homogeneous mixing.

A considerable disadvantage of the known static mixers resides in the fact that the mixer elements, produced with complex geometry, have to be produced in complicated production processes, which give rise to a considerable expenditure in time and cost. Above all, the partly solid configuration of the mixers with differently aligned passages makes a high expenditure on material necessary.

A further disadvantage of known mixers is that cleaning of the mixers is made considerably more difficult, because of the deflection surfaces being at changing angles to one another Reliable, simple cleaning, for example by means of a cleaning fluid merely flowing through the mixer, is inadequate.

SUMMARY OF THE INVENTION

The invention is accordingly based on the object of providing a static mixer which makes possible efficient homogenization and dispersion of various media with constructionally simple mixer elements, which can additionally be produced cost-effectively and are simple to clean.

The object is achieved by a mixer element having at least one deflection surface which is aligned at an angle of 70 to 110° to the main flow direction of the media in the line through which flow passes.

Here, the invention is based on the idea that during the impact of the media on the deflection surface, which is inclined only slightly with respect to the flow direction, and during the flow around its edges, shear forces are produced which lead to swirling and mixing of the media.

The particular advantage of the mixer element according to the invention lies in its simple construction, which can be fabricated cost-effectively and without special machines.

A further advantage is that, because of the special alignment of the deflection surface, there are no acute angles between the surface and the surrounding housing or the wall. The cleaning of the mixer element is therefore made considerably easier.

Surprisingly, the deflection surface inclined only slightly with respect to the flow direction permits very good homogenization of the media to be mixed thoroughly, which can be improved still further by a plurality of deflection surfaces connected one after another.

In a particularly preferred embodiment, the deflection surface is arranged at an angle of 90° with respect to the flow direction of the media, that is to say it is at right angles to the flow direction.

The particularly good result achieved in this way was not to be suspected on the basis of the known considerations of the average person skilled in the art which, on account of the assumed requirements of the pressure drop to be minimized as far as possible, of the most variable possible forcible guidance of the flow and of the avoidance of dead zones, would make a deflection surface inclined only slightly with respect to the flow direction or one at right angles thereto appear particularly unsuitable. This is because a deflection surface arranged in this way permits the production of dead zones located behind it and, to a considerable extent, "brakes" the flow impinging on it. This leads to a considerable reduction in the pressure and the velocity of the liquid. Furthermore, the deflection surface according to the invention dispenses with directed forcible guidance, which leads to repeated specific rotation of the flow direction of the medium.

In the mixer element according to the invention, the form of the cross section of the deflection surface can correspond substantially to the cross-sectional outline of the line through which flow passes. However, its diameter is advantageously smaller than that of the line, so that at least one passage for the medium deflected by the deflection surface is produced between the line and the deflection surface.

The deflection surface can be fastened directly by fastening means to the line through which flow passes or to a housing of a mixer element to be inserted into the line.

In a particular embodiment, it can additionally be advantageous to insert the mixer element into the line via an adapter.

The housing of the mixer element can advantageously be configured in such a way that the side surfaces of the housing located behind the deflection surface in the flow direction are used to guide the medium.

For example, they can taper in the manner of a funnel, in order to narrow toward a passage opening leading to a deflection surface of a deflection surface connected downstream or located in the same mixing system.

As a result of the narrowing, the pressure energy of the flow is partly converted into kinetic energy. The shear forces which are produced on the impact on the deflection surface and promote homogenization are therefore increased.

In a further advantageous embodiment, the deflection surface can be provided with openings, which permit the medium striking the surface to be divided. An improvement in the homogenization can therefore be achieved but without cleaning of the system being made considerably more difficult.

The individual mixer elements can be connected one behind another in a large number in a mixing system. It can additionally also be advantageous to connect mixer elements beside one another in parallel if, for example, the flow rate of media is to be increased.

The mixer element according to the invention can be used for the homogenization and mixing of gases, liquids, suspensions or dispersions. It can therefore be used in a large number of different processes and apparatuses, for example from the areas of chemical or process engineering, and also in the plastics industry, water treatment or the foodstuffs industry.

Specifically, it can be used for mixing drilling liquids, for example bentonite-water suspensions, which are needed for example for horizontal or vertical drilling.

In the following text, the invention will be explained in more detail using an exemplary embodiment illustrated in the drawings, in which:

DESCRIPTION OF PREFERRED EMBODIMENTS

Figure 1:
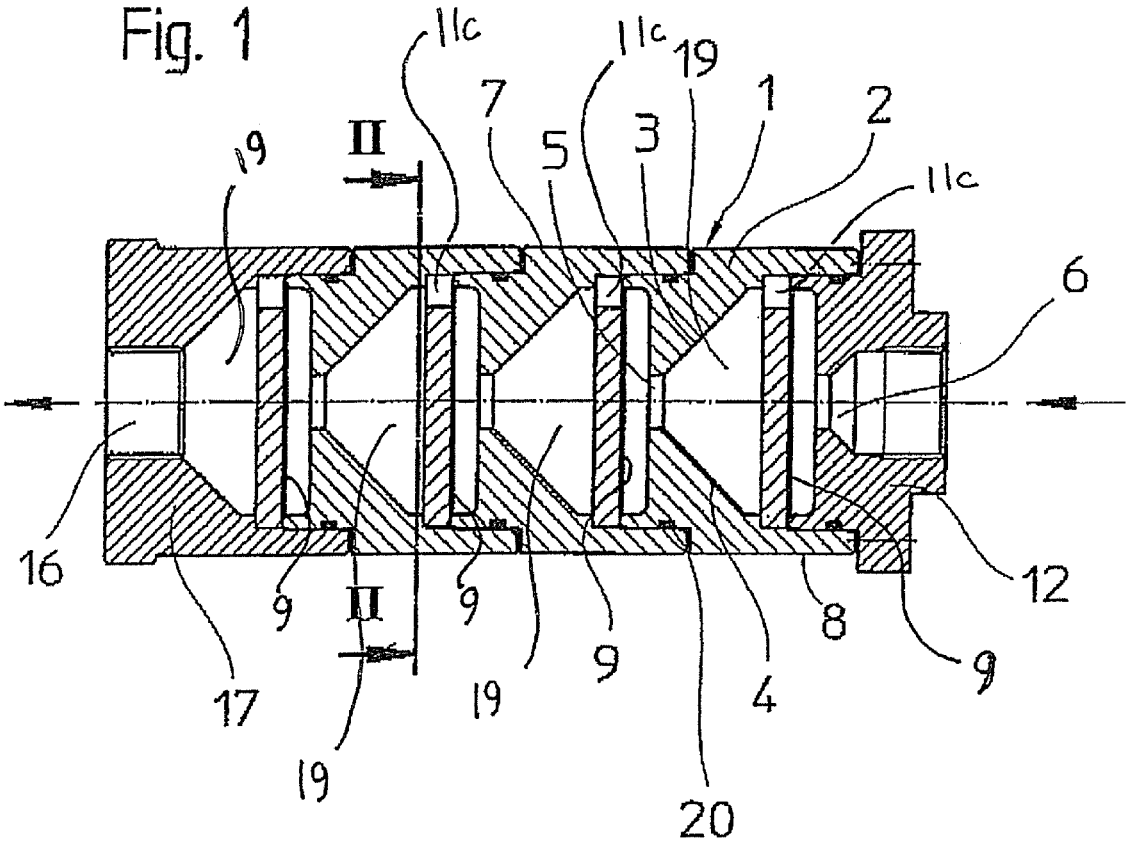
FIG. 1 shows a longitudinal section through a mixing system comprising a plurality of individual elements according to the invention connected one after another and FIG. 2 shows a sectional view taken along II-II in FIG. 1.

An individual element 1 of the mixing system comprises a housing 2 with two inclined surfaces 3 and 4, which narrow in the manner of a funnel toward a passage opening 5. They allow the passage of the medium flowing into the mixing system through the inlet opening 6 in the direction of the arrow.

Figure 2:
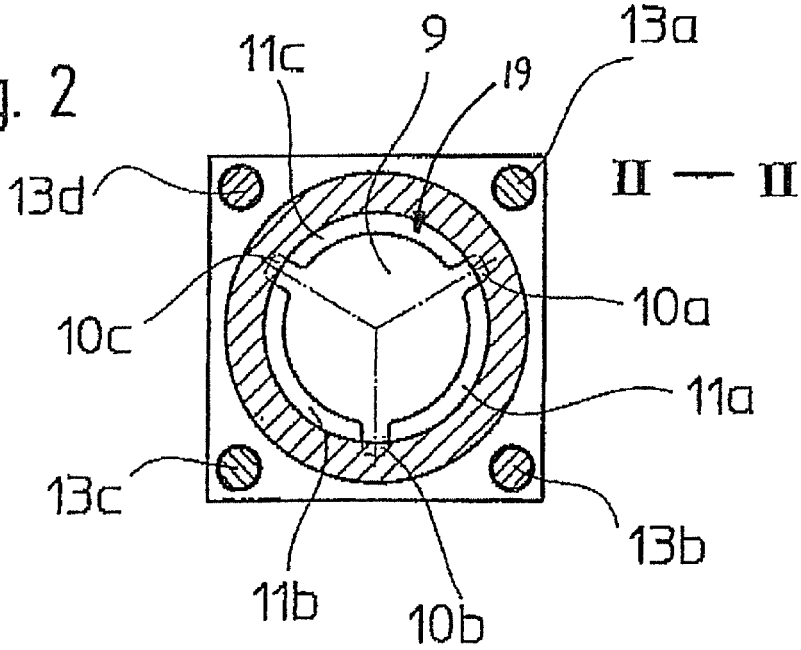

The deflection surface 9 (of which there may be more than one as shown in FIG. 1), disposed at right angles to the outer surfaces 7, 8 of the housing, has a generally circular cross-section (FIG. 2) to define a radially outer annular passageway between the deflection surface 9 and inside walls of the housings 2. The deflection surface 9 is clamped between the housings 2 by three spaced apart tongues 10*a*, 10*b*, 10*c*, thereby defining radially outer semiannular passageways 11*a*, 11*b* and 11*c* between tongues 10*a*, 10*b*, 10*c* as shown in FIG. 2. At the location where deflection surface 9 is positioned, in comparison to the inside walls of the housing (i.e., outer walls defining mixing chamber 19), deflection surface 9 has a smaller radius (cross-section), thus defining the radially outer semiannular passageway(s) 11*a*, 11*b*, 11*c* between the tongues for the bentonite-water suspension so that passages 11*a*, 11*b*, 11*c* remain free between the housing 2 and the deflection surface 9. Parts 13*a* to *d* represent tie rods, which pull the top piece 12 and the end piece 17 toward each other and in this way clamp the deflection surfaces 9 firmly through the housings.

In the exemplary embodiment, a mixing system is assembled from three individual elements each having a deflection surface and a top piece 12 and an end piece 17. These are sealed off from one another by seals 20. As shown in FIG. 2, the mixing chamber of the one or more of the mixing elements has a generally circular cross-section. This arrangement can be supplemented as desired by further mixer elements.

The top piece has an inlet opening 6, which opens onto the first deflection surface, machined as a constituent part of the top piece. The opening is machined in the manner of a funnel.

The end piece 17, on the other hand, does not have a deflection surface, but lets the medium out through the outlet opening 16. End piece 17 and top piece 12 are provided with a thread (not shown here), into which common pipe screw fixings can be screwed.

The media flow into the top piece 12 via the inlet opening 6 and strike the deflection surface 9. There, they are deflected and flow through the passages 11*a*, 11*b*, 11*c* into the mixing chamber 19. They are to some extent guided along the oblique surfaces 3 and 4. The media then flow through the passage opening 5 onto a further deflection surface. They flow through a second mixer element in the manner just described.

After flowing through the last mixer element, they pass into the outlet opening 16 of the end piece 17 and leave the mixing system.

The invention claimed is:

1. A static mixer apparatus for mixing a bentonite-water suspension, comprising:

a top piece and at least two mixer elements arranged in series thereafter, said top piece having an inlet opening for the bentonite-water suspension;

a first mixer element including a housing having a longitudinal axis and being operably connected to said top piece;

said first mixer element housing having a passage opening for the flow of said bentonite-water suspension;

a mixing chamber in flow communication with said passage opening, said mixing chamber being defined by oblique wall surfaces wherein said oblique wall surfaces taper toward said passage opening;

a first, flat deflection surface positioned downstream of said inlet opening, upstream of said first mixer element mixing chamber and generally disposed at an angle between 70°-110° with respect to said longitudinal axis of said first mixer element housing;

a second mixer element including a housing having a longitudinal axis and being operably connected to said first mixer element;

said second mixer element housing having a passage opening for the flow of said bentonite-water suspension;

a mixing chamber defined by oblique wall surfaces wherein said oblique wall surfaces of said second mixer element mixing chamber taper in the same direction as the taper of the wall surfaces of said first mixer element mixing chamber;

a second, flat deflection surface positioned downstream of said first mixer element passage opening and upstream of said second mixer element mixing chamber and generally disposed at an angle between 70°-110° with respect to said longitudinal axis of said second mixer element housing;

wherein the inside walls of said housing of at least one of said mixer elements has a generally circular cross-section;

said deflection surface of at least one of said mixer elements has a generally circular cross-section; and wherein at least one of said deflection surfaces has a smaller cross-section than the inside walls of said housing of said mixer element at the location where said deflection surface is positioned thereby defining a radially outer annular passageway for the bentonite-water suspension.

2. The static mixer apparatus as claimed in-claim 1, further comprising:

a plurality of spaced-apart tongues extending from said deflection surface of at least one of said mixer elements; and wherein said radially outer annular passageway has a width which is generally defined by the length of said tongues measured from said outside edge to said interior surface of said housing of said one of said mixer elements.

3. The static mixer apparatus according to claim 2, wherein:

said tongues of said first deflection surface are clamped between said top piece and said first mixer element housing;

said tongues of said second deflection surface are clamped between said first mixer element housing and said second mixer element housing.

4. The static mixer apparatus as claimed in claim 1, further comprising one or more further mixer elements arranged downstream of said first mixer element and upstream of said second mixer element, said further mixer element including a housing having a longitudinal axis;

said further mixer element having a passage opening for the flow of bentonite-water suspension and a mixing chamber in flow communication with said passage opening, said mixing chamber being defined by oblique wall surfaces wherein said oblique wall surfaces taper toward said passage opening; and a further, flat deflection surface positioned downstream of said first mixer element passage opening and upstream of said further mixer element mixing chamber and generally disposed at an angle between 70°-110° with respect to said longitudinal axis of said further mixer element housing;

wherein:

the inside walls of said housing of at least one of said further mixer elements has a generally circular cross-section;

said deflection surface of at least one of said further mixer elements has a generally circular cross-section; and wherein said deflection surface of at least one of said further mixer elements has a smaller cross-section than the inside walls of said housing of said mixer element at a location where said deflection surface is positioned thereby providing a radially outer annular passageway.

5. The static mixer apparatus as claimed in claim 1 wherein said second mixer element is operably connected to an end piece, said end piece having an outlet opening for the flow of bentonite-water suspension.

6. The static mixer apparatus as claimed in claim 5 wherein said end piece includes a housing having a longitudinal axis;

a mixing chamber in flow communication with said outlet opening, said mixing chamber being defined by oblique wall surfaces wherein said oblique wall surfaces taper toward said outlet opening;

a third flat deflection surface downstream of said passage opening of said second mixer element and upstream of said outlet opening and generally disposed at an angle between 70°-110° with respect to said longitudinal axis of said first mixer element housing;

wherein:

said deflection surface of said end piece has a generally circular cross-section; and said deflection surface of said end piece has a smaller cross-section than said mixing chamber of said end piece where said third deflection surface is positioned thereby providing a radially outer annular passageway for the bentonite-water suspension.

7. The static mixer apparatus as claimed in claim 6, further comprising:

a plurality of spaced-apart tongues extending from said third deflection surface; and wherein said radially outer annular passageway has a width which is generally defined by the length of said tongues measured from an outside edge of said deflection surface to said interior surface of said housing of said one of said mixer elements.

8. The static mixer apparatus according to claim 7, wherein:

said tongues of said third deflection surface are clamped between said end piece and said second mixer element housing.

9. The static mixer apparatus according to claim 1 wherein said top piece has one inlet opening.

* * * * *